US006773303B1

(12) United States Patent
Lin

(10) Patent No.: US 6,773,303 B1
(45) Date of Patent: Aug. 10, 2004

(54) COAXIAL CABLE HAVING EASILY ATTACHED COUPLER

(75) Inventor: Kao Shen Lin, Chong Ho (TW)

(73) Assignee: Gih Sheng Co., Ltd.

( * ) Notice: Subject to any disclaimer, the term of this patent is extended or adjusted under 35 U.S.C. 154(b) by 0 days.

(21) Appl. No.: 10/428,450

(22) Filed: Apr. 30, 2003

(51) Int. Cl.[7] ..... H01R 13/40

(52) U.S. Cl. ..... 439/578; 174/74 RC; 174/75 RC; 439/585

(58) Field of Search ..... 439/578, 583–585; 174/74 RC, 75 RC

(56) References Cited

U.S. PATENT DOCUMENTS 3,683,320 A * 8/1972 Woods et al. ..... 439/198
3,706,958 A * 12/1972 Bianchenot ..... 439/584
3,761,870 A * 9/1973 Drezin et al. ..... 439/584
3,846,738 A * 11/1974 Nepovim ..... 439/584
3,847,463 A * 11/1974 Hayward et al. ..... 439/28
3,854,789 A * 12/1974 Kaplan ..... 439/584
5,183,411 A 2/1993 Yu ..... 439/578
5,232,377 A * 8/1993 Leibfried, Jr. ..... 439/320
5,269,701 A * 12/1993 Leibfried, Jr. ..... 439/578
5,548,088 A * 8/1996 Gray et al. ..... 174/74 R
5,651,698 A * 7/1997 Locati et al. ..... 439/578
6,027,373 A * 2/2000 Gray et al. ..... 439/578
6,183,298 B1 * 2/2001 Henningsen ..... 439/578
6,575,785 B2 * 6/2003 Bohmer et al. ..... 439/578

* cited by examiner

*Primary Examiner*—P. Austin Bradley
*Assistant Examiner*—Larisa Tsukerman

(57) ABSTRACT

A coaxial cable includes a pipe engaged onto a coaxial cable member, and a conduit has one or more teeth for engaging onto the coaxial cable member. A tubular housing is threaded to the pipe, and includes an inner peripheral swelling to retain the outer conductor of the coaxial cable member between the peripheral swelling of the tubular housing and the pipe. A head is engaged onto the central conductor of the coaxial cable member, and has a tip. An insulating sleeve is engaged onto the head. A ferrule may be threaded with the housing, and to secure the housing and the conduit to the coaxial cable member without additional fasteners or tools.

10 Claims, 11 Drawing Sheets

COAXIAL CABLE HAVING EASILY ATTACHED COUPLER

BACKGROUND OF THE INVENTION

1. Field of the Invention

The present invention relates to a coaxial cable, and more particularly to a coaxial cable having a coupler easily attached to the cable without additional fasteners or tool members.

2. Description of the Prior Art

Various kinds of typical coaxial cables have been developed for coupling television facilities, computer facilities or the like to aerial antenna members, or the like, and comprise a plug member or a coupler member attached to one end of the cable member for coupling to either the television facilities, the computer facilities or the aerial antenna members, or the like.

Normally, the coupler members or the plug members comprise a ring-shaped element to be pressed and secured onto the cable member by pliers devices or the like, or by additional fasteners and/or tool members. Accordingly, the users or the workers have to carry a lot of fasteners and tool members for attaching the plug members onto the ends of the cable members.

For example, U.S. Pat. No. 5,183,411 to Yu discloses one of the typical coaxial cables including a hollow metal tube, a plug member and a plastic protective sleeve to be secured onto one end of the cable member. Similarly, the coupler members or the plug members are required to be compressed and secured onto the cable member by additional fasteners and/or tool members. It is difficult for the non-skillful users to attach or secure the coupler members or the plug members onto the cable member by themselves.

The present invention has arisen to mitigate and/or obviate the afore-described disadvantages of the conventional coaxial cables.

SUMMARY OF THE INVENTION

The primary objective of the present invention is to provide a coaxial cable including a coupler to be easily and quickly attached to the coaxial cable member without additional fasteners or tool members.

In accordance with one aspect of the invention, there is provided a coaxial cable comprising a coaxial cable member including a central conductor and an outer conductor, a pipe engaged onto the coaxial cable member and including an outer thread formed thereon, a conduit engaged onto the coaxial cable member and contacted with the pipe, and including at least one tooth engaged onto the coaxial cable member, for securing the conduit onto the coaxial cable member, the outer conductor of the coaxial cable member being engageable onto the pipe, a tubular housing including an inner thread formed therein to thread with the outer thread of the pipe, and including a peripheral swelling extended therein to engage with the outer conductor of the coaxial cable member, and to retain the outer conductor of the coaxial cable member between the peripheral swelling of the tubular housing and the pipe, the tubular housing including an outer thread formed thereon, a head engaged onto the central conductor of the coaxial cable member, and including a tip extended therefrom, an insulating sleeve a passage formed therein to receive the head, and received in the tubular housing, and a ferrule including a chamber formed therein to receive the coaxial cable member and the pipe and the conduit, and including an inner thread formed therein to thread with the outer thread of the tubular housing, and to secure the tubular housing and the pipe and the conduit to the coaxial cable member. The ferrule includes an actuating member provided therein to engage with the conduit and to force the tooth of the conduit onto the coaxial cable member, without additional fasteners or tools.

The conduit includes at least one groove formed therein to define at least one blade thereon, and to increase a resilience of the conduit, and to allow the tooth of the conduit to be resiliently clamped onto the coaxial cable member.

The pipe includes an inclined surface formed therein to engage with the outer conductor of the coaxial cable member. The tubular housing includes an inclined surface formed in the peripheral swelling thereof, to engage with the inclined surface of the pipe, and to retain the outer conductor of the coaxial cable member between the inclined surfaces of the tubular housing and the pipe.

The conduit includes an inclined surface formed therein, the actuating member of the ferrule is an inclined surface to engage with the inclined surface of the conduit, and to force the tooth of the conduit onto the coaxial cable member.

The head includes a bore formed therein to receive the central conductor of the coaxial cable member, and includes at least one slot formed therein to increase a resilience of the head.

A tubular connector and a barrel may further be provided, and the barrel may be engaged through the connector and secured to the tubular housing, to rotatably attach the connector to the tubular housing.

The tubular connector includes a peripheral rib extended therein, and the barrel includes a peripheral flange extended outwardly therefrom, to engage with the peripheral rib of the connector, and to rotatably couple the connector to the tubular housing.

The barrel includes a peripheral rib extended therein to engage with the sleeve, and to retain the sleeve within the barrel. The sleeve includes a peripheral flange extended therein to engage with the head, and to retain the head within the sleeve.

Further objectives and advantages of the present invention will become apparent from a careful reading of the detailed description provided hereinbelow, with appropriate reference to the accompanying drawings.

DETAILED DESCRIPTION OF HIRE PREFERRED EMBODIMENT

Figure 1:
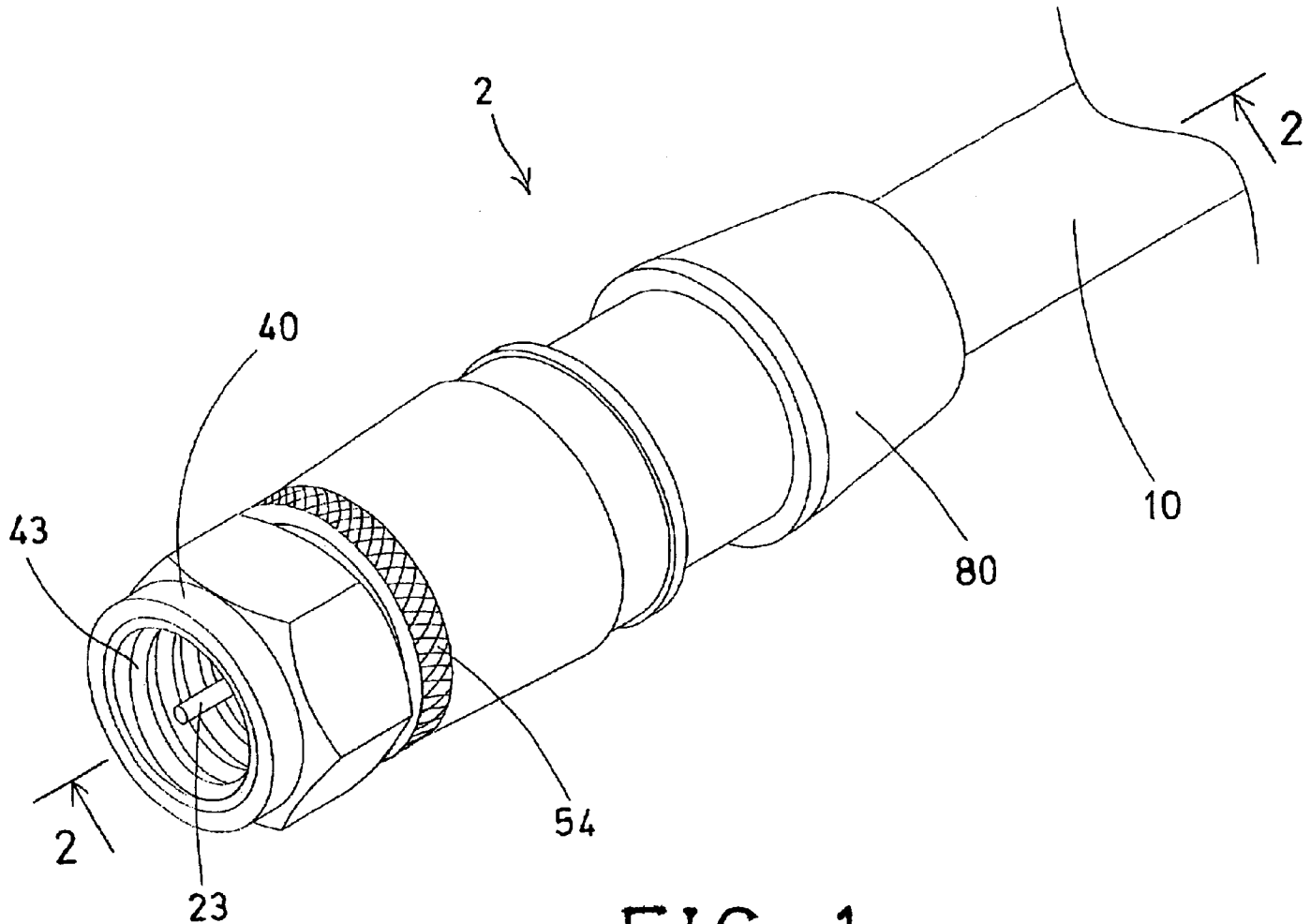
FIG. 1 is a partial perspective view of a coaxial cable and a coupler in accordance with the present invention.

Referring to the drawings, and initially to FIGS. 1–4, a coaxial cable in accordance with the present invention comprises a coaxial cable member 10 and a coupler 2 to be attached to one end of the coaxial cable member 10. As shown in FIGS. 2 and 10–13, the coaxial cable member 10 includes a typical central conductor 11, a typical peripheral or outer conductor 12, and a typical insulating layer 14 disposed between the central conductor 11 and the outer conductor 12.

As shown in FIGS. 2–6, the coupler 2 includes a head 20 having a bore 21 formed therein to receive the central conductor 11 of the coaxial cable member 10. The head 20 includes one or more slots 22 formed therein to increase the resilience of the head 20, and for allowing the central conductor 11 of different diameters to be solidly engaged into the bore 21 of the head 20, and to be secured to the head 20.

The head 20 includes a conductor tip 23 extended forwardly therefrom. The conductor tip 23 includes an outer diameter smaller than that of the head 20, so as to form or define an outer peripheral shoulder 24 between the head 20 and the conductor tip 23.

An insulating sleeve 30 includes a passage 31 formed therein to receive the head 20, and includes a peripheral flange 32 extended into the front portion of the passage 31 thereof, to form or define a peripheral shoulder 33 therein, and to engage with the outer peripheral shoulder 24 of the head 20, and thus to anchor or to position the head 20 within the passage 31 of the insulating sleeve 30.

Figure 11:
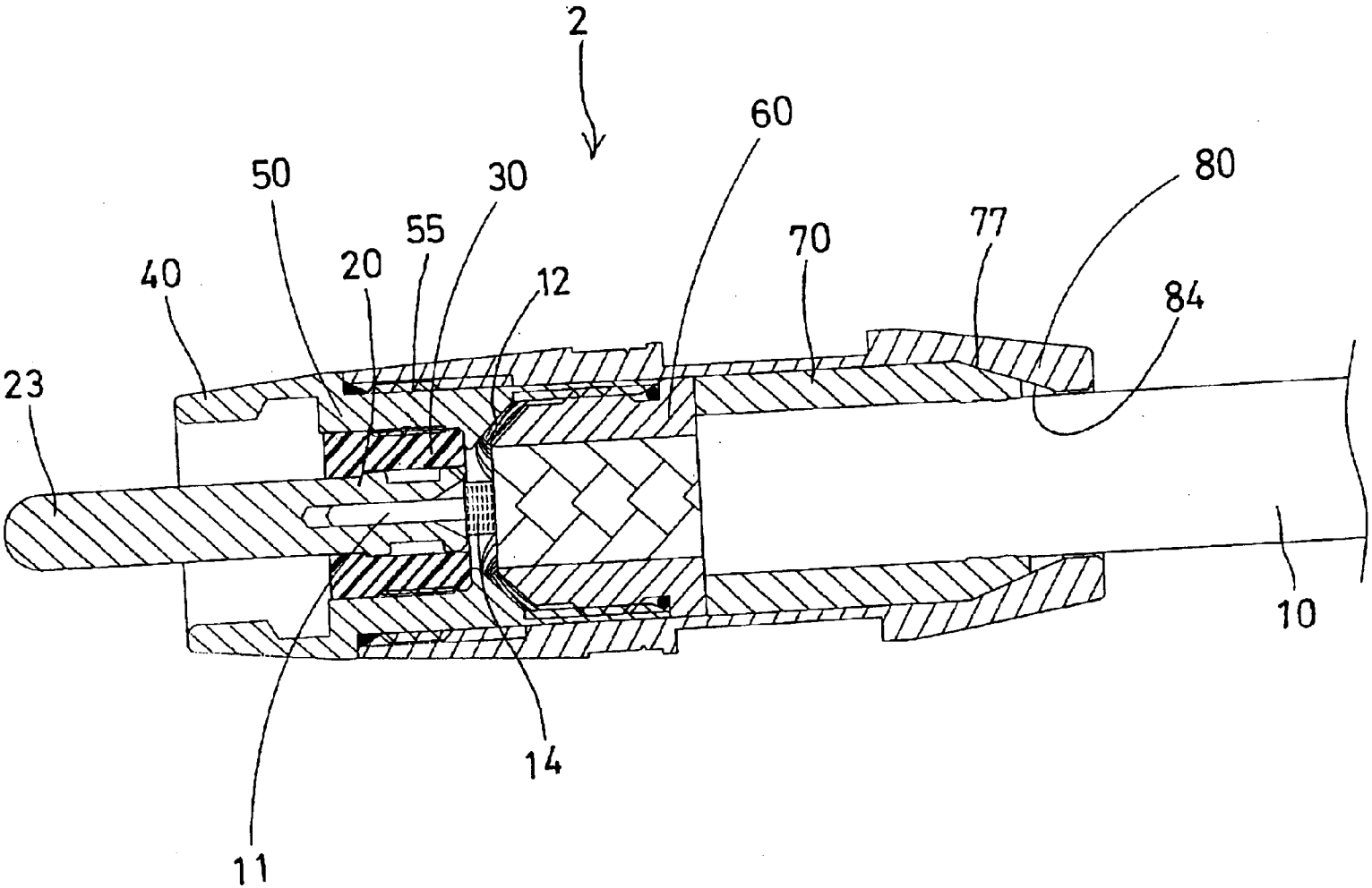
Figure 12:
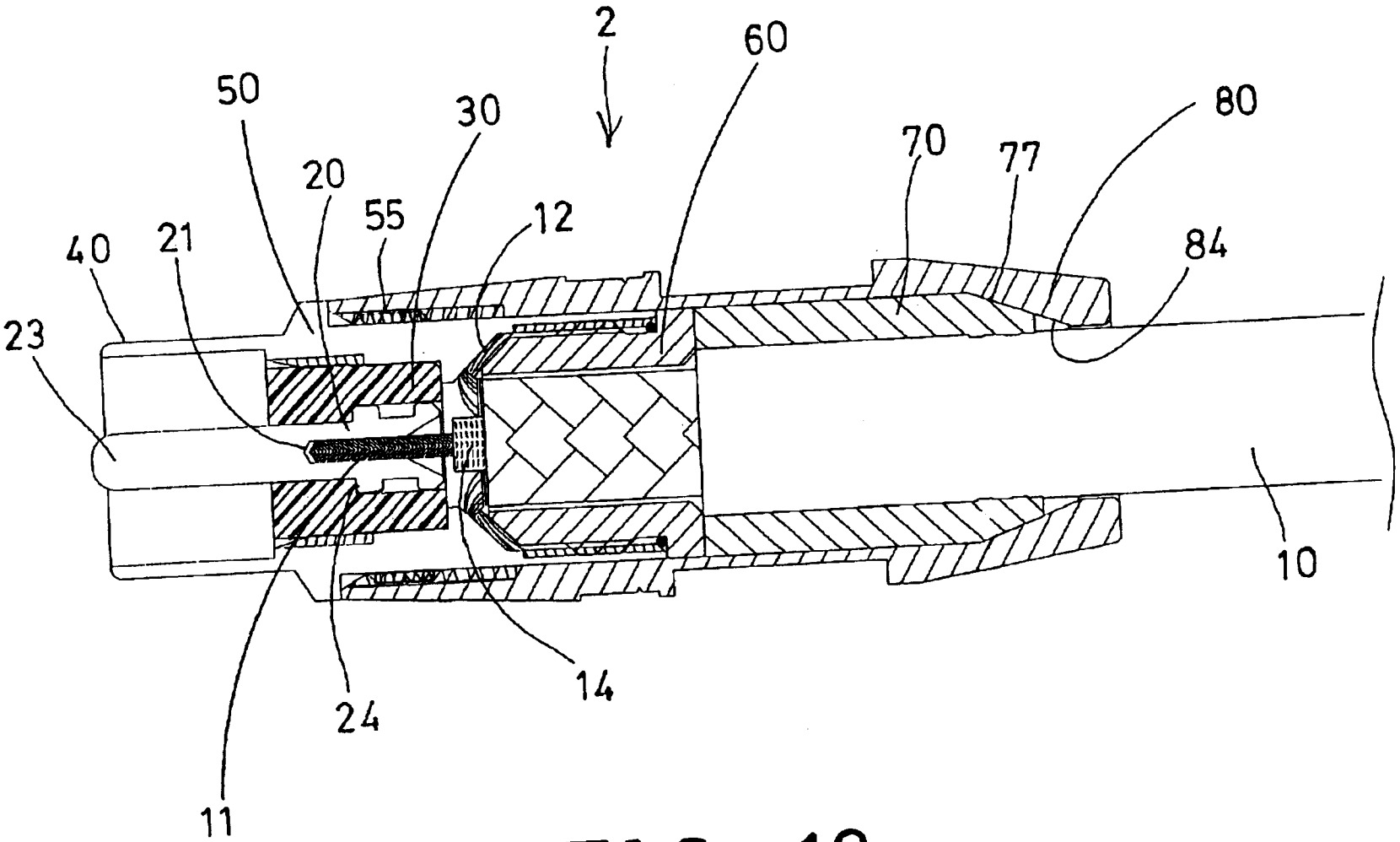
Figure 13:
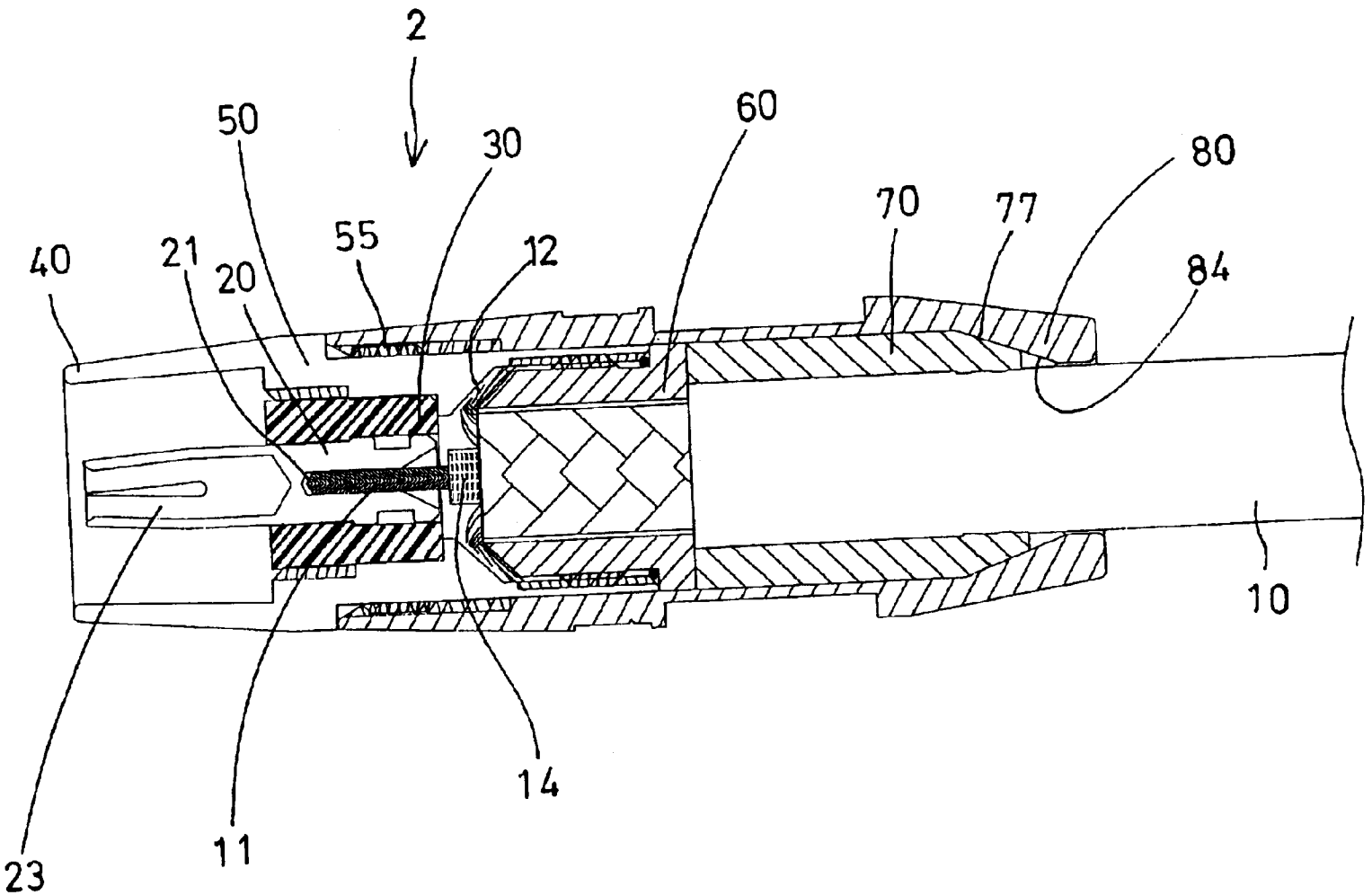

As shown in FIGS. 10–13, the conductor tip 23 of the head 20 may be formed into various shapes or contours or configurations, such as may include sharp tip 23 (FIG. 10), rounded tips 23 (FIGS. 11 and 12, or split tip 23 as shown in FIG. 13. The head 20 may also include one or more peripheral shoulders thereon to engage with that of the insulating sleeve 30, and thus to anchor or secure the head 20 within the insulating sleeve 30.

A barrel 34 includes a space 35 formed therein to receive the sleeve 30 and the head 20, and includes a peripheral rib 36 extended into the front portion of the space 35 thereof, to form or define a peripheral shoulder 37 therein, and to engage with the sleeve 30, and thus to anchor or to position the sleeve 30 within the space 35 of the barrel 34. The barrel 34 includes a peripheral flange 38 extended outwardly from such as the front portion thereof, to form or define an outer peripheral shoulder 39 thereon.

A tubular connector 40 includes a chamber 41 formed therein, and includes a peripheral rib 42 extended into the rear portion of the chamber 41 thereof, to form or define a peripheral shoulder 43 therein, and to engage with the outer peripheral shoulder 39 of the peripheral flange 38 of the barrel 34, and thus to rotatably anchor or couple the barrel 34 to the connector 40. The connector 40 includes an inner thread 44 formed therein.

A tubular housing 50 includes a bore 51 formed therein to receive the barrel 34, and includes a peripheral swelling 52 extended into the middle portion of the bore 51 thereof, to engage with the barrel 34, and to position the barrel 34 to the tubular housing 50. The barrel 34 and the tubular housing 50 may be solidly secured together with such as force-fitted engagements, adhesive materials, and/or by welding processes.

As shown in FIGS. 10–13, the connector 40 and the barrel 34 and the tubular housing 50 may also be solidly secured together or solidly formed integral with each other as a one-integral-piece.

The tubular housing 50 includes an inclined surface 53 formed in the peripheral swelling 52 thereof, and facing rearwardly, and includes a knurled outer peripheral portion 54 for allowing the users to firmly grasp or hold the tubular housing 50, and includes an outer thread 55 formed in such as the middle and outer peripheral portion thereof, and an inner thread 56 formed in such as the rear and inner peripheral portion thereof.

A pipe 60 includes a bore 61 formed therein to receive the coaxial cable member 10, and includes an outer thread 62 formed in such as the middle and outer peripheral portion thereof, for threading with the inner thread 56 of the tubular housing 50, and for securing the pipe 60 to the tubular housing 50.

The pipe 60 includes an inclined surface 63 formed in the front portion thereof, and facing forwardly to engage with the inclined surface 53 of the tubular housing 50, and includes a knurled outer peripheral portion 64 formed on the rear end 66 thereof for allowing the users to firmly grasp or hold the pipe 60.

As shown in FIGS. 2 and 10–13, the free end portion of the outer conductor 12 may be folded outwardly and engaged onto the outer peripheral portion of the pipe 60, and may be solidly retained between the inclined surfaces 53, 63 of the peripheral swelling 52 of the tubular housing 50 and the pipe 60.

A conduit 70 includes a bore 71 formed therein to receive the coaxial cable member 10, and includes one or front end 72 for contacting or engaging with the rear end 66 of the pipe 60, and includes an inner thread or one or more inner peripheral teeth 73 formed or extended into the rear portion thereof, for engaging with the coaxial cable member 10, and for securing onto the coaxial cable member 10.

The conduit 70 includes one or more grooves 74 formed in the rear portion thereof to form or define one or more blades 75 thereon, and for increasing the resilience of the rear portion of the conduit 70, and thus for allowing the inner peripheral teeth 73 of the conduit 70 to be easily or resiliently forced or clamped onto the coaxial cable member 10. The conduit 70 includes an inclined surface 77 formed in the rear portion thereof, and facing rearwardly.

A ferrule 80 includes a chamber 81 formed therein to receive the coaxial cable member 10 and the pipe 60 and the conduit 70, and includes an inner thread 83 formed in the front portion thereof for threading with the outer thread 55 of the tubular housing 50, and thus for securing the head 20, the sleeve 30, the barrel 34, the connector 40, the tubular housing 50, the pipe 60, the conduit 70 and the ferrule 80 together.

The ferrule 80 includes an actuating member or inclined surface 84 formed in the inner and rear portion thereof, and for engaging with the inclined surface 77 of the conduit 70, and for forcing the blades 75 of the conduit 70 onto the coaxial cable member 10, so as to solidly clamp or secure the conduit 70 onto the coaxial cable member 10, when the ferrule 80 is threaded to the tubular housing 50.

Figure 2:
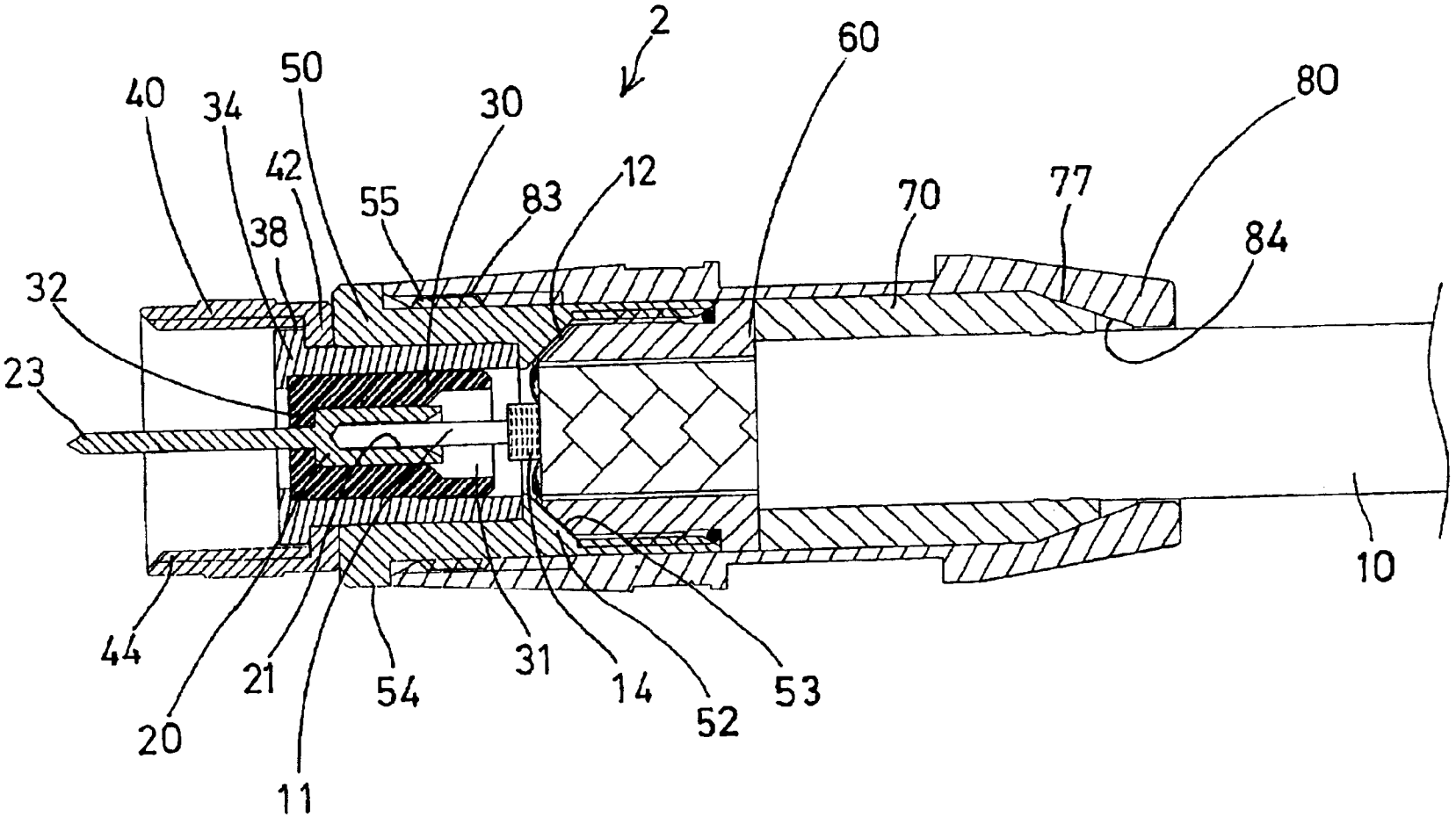
FIG. 2 is a partial cross sectional view taken along lines 2—2 of FIG. 1.
Figure 3:
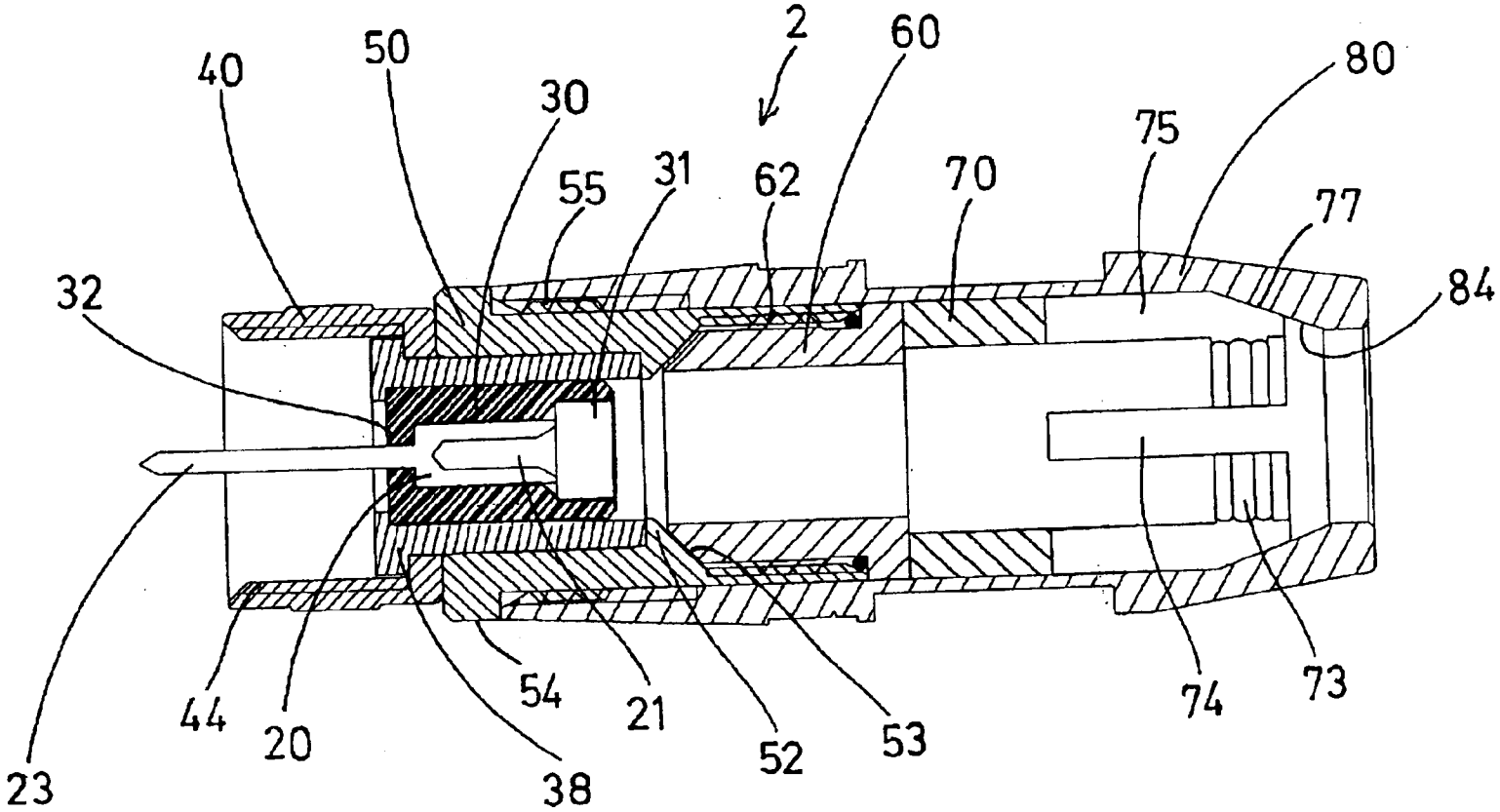
FIG. 3 is a partial cross sectional view similar to FIG. 2, in which the coaxial cable has been removed from the coupler.
Figure 4:
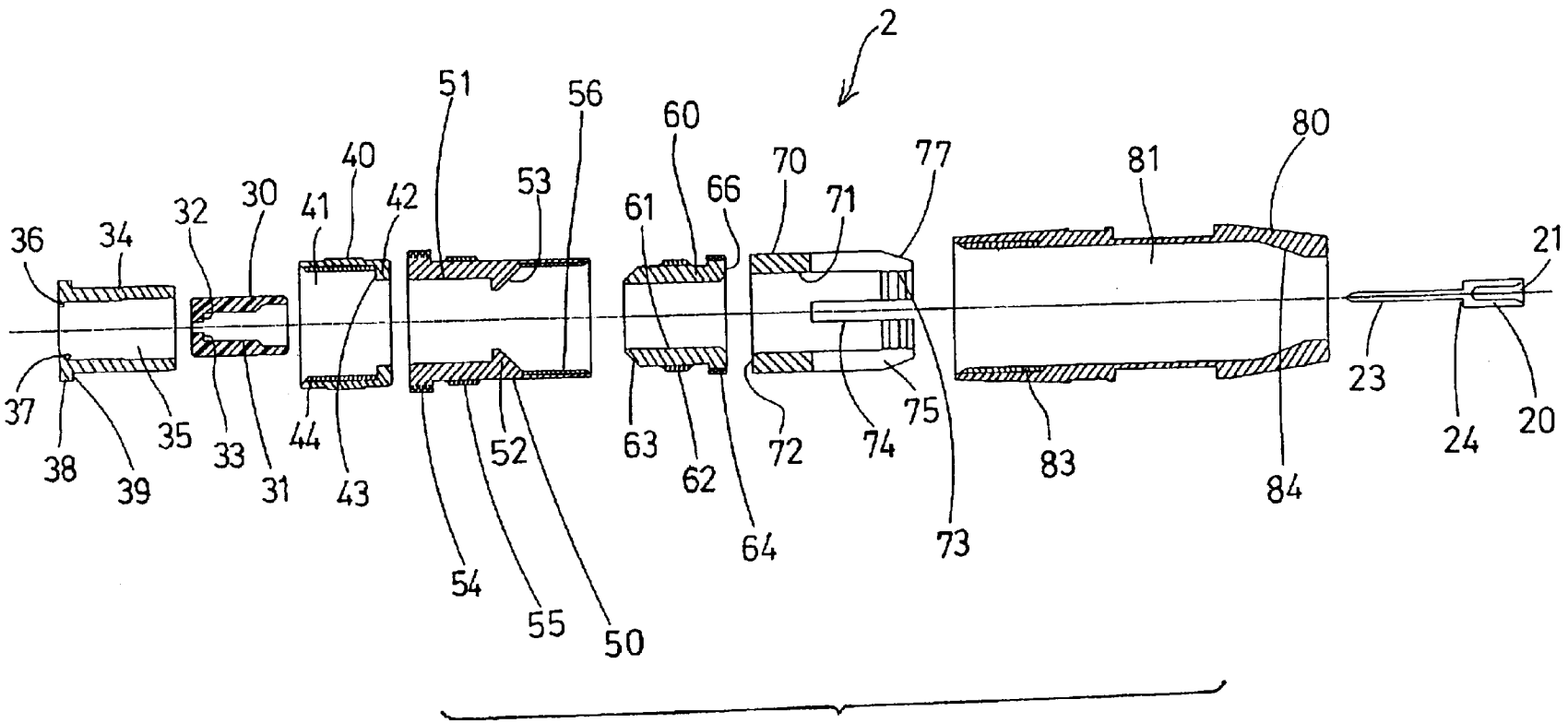
FIG. 4 is a plan and exploded view of the coupler of the coaxial cable.
Figure 6:
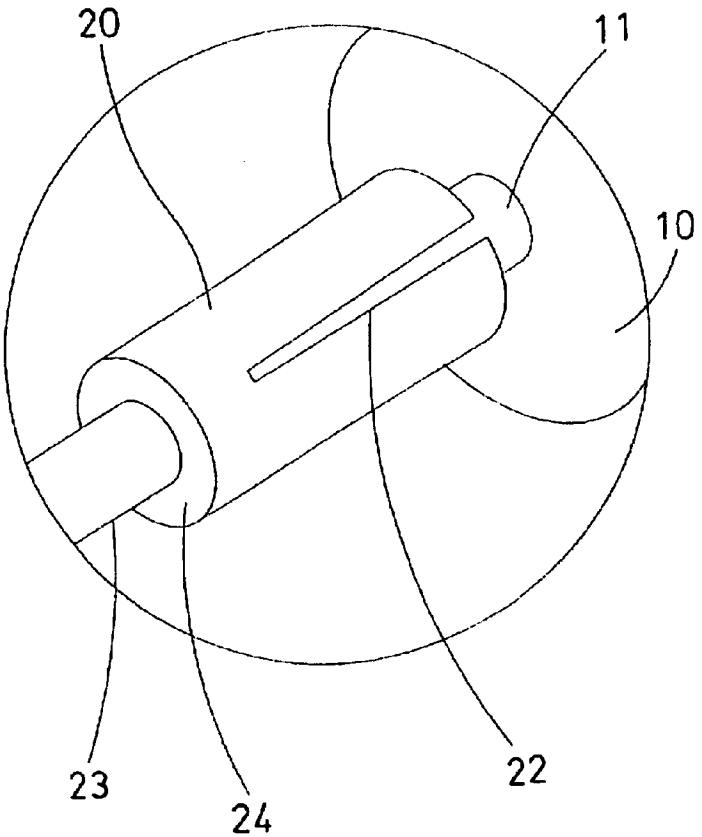
FIG. 6 is an enlarged partial perspective view similar to FIG. 5, illustrating the attachment of the head of the coupler onto the coaxial cable.
Figure 5:
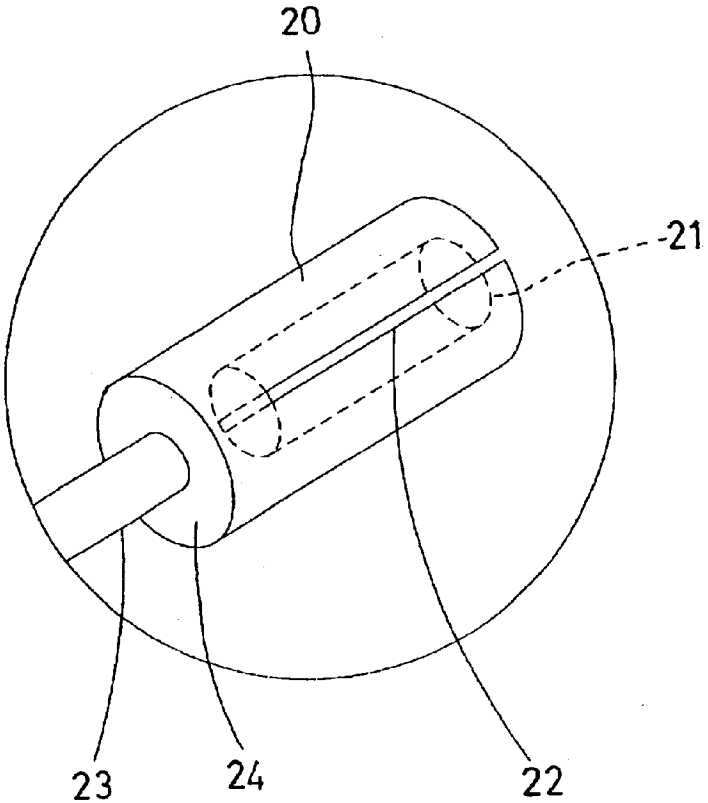
FIG. 5 is an enlarged partial perspective view of a head of the coupler.
Figure 7:
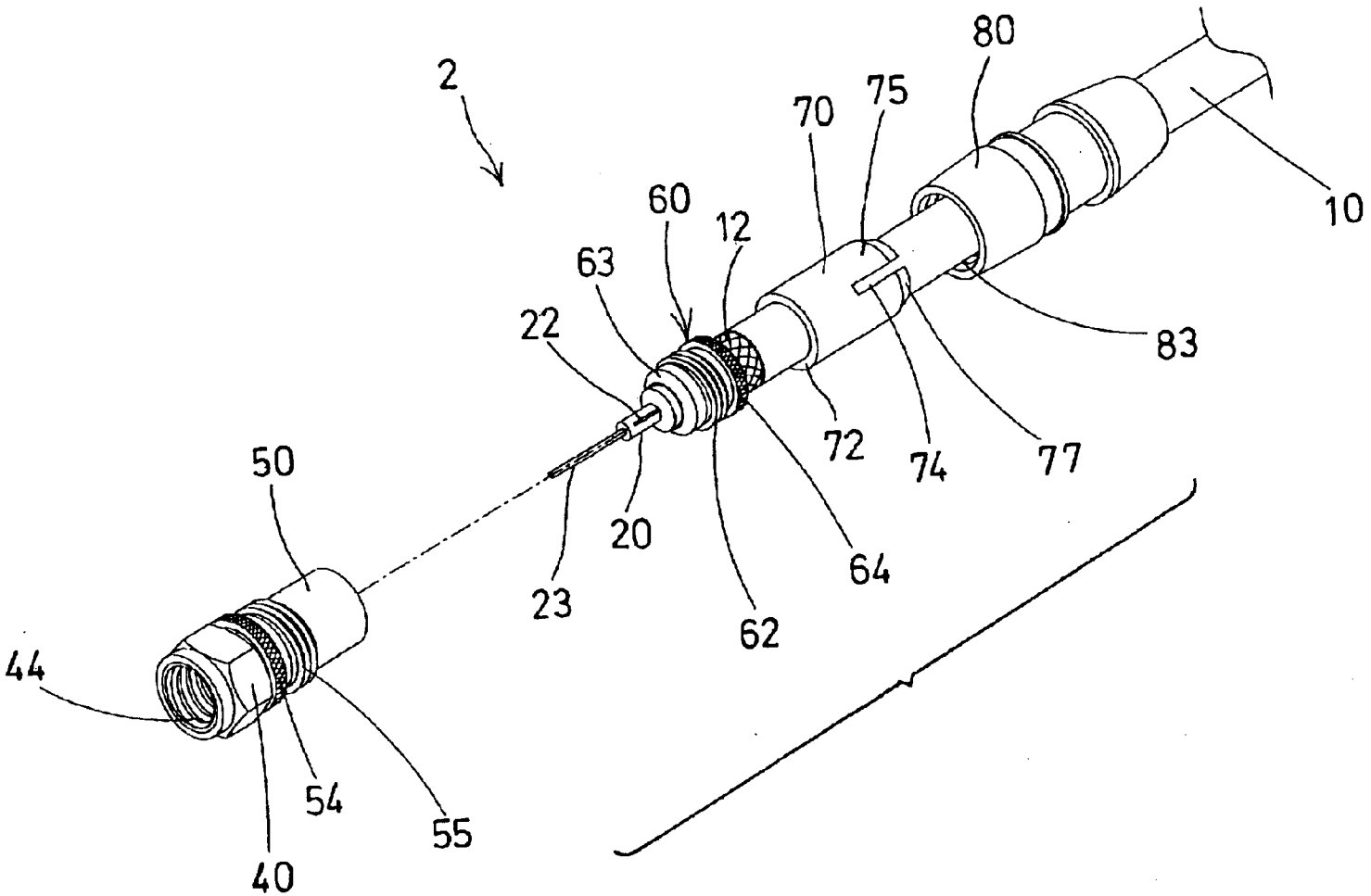
FIG. 7 is a partial exploded view illustrating the attachment of the coupler onto the coaxial cable.
Figure 8:
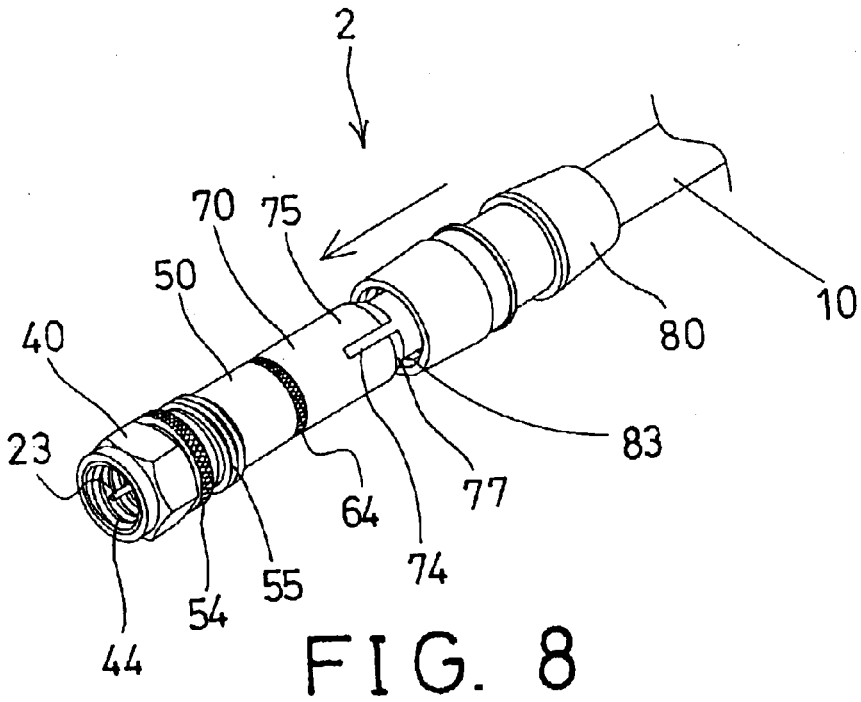
FIGS. 8 and 9 are perspective views illustrating the attachment of the coupler onto the coaxial cable.
Figure 9:
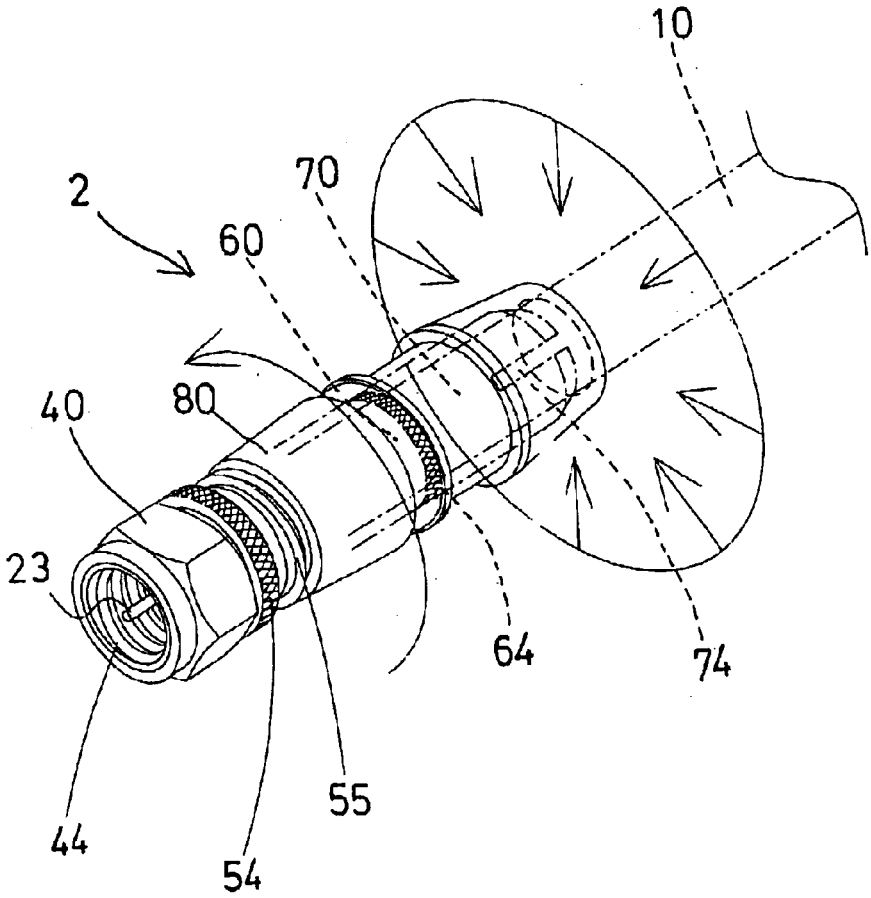
Figure 10:
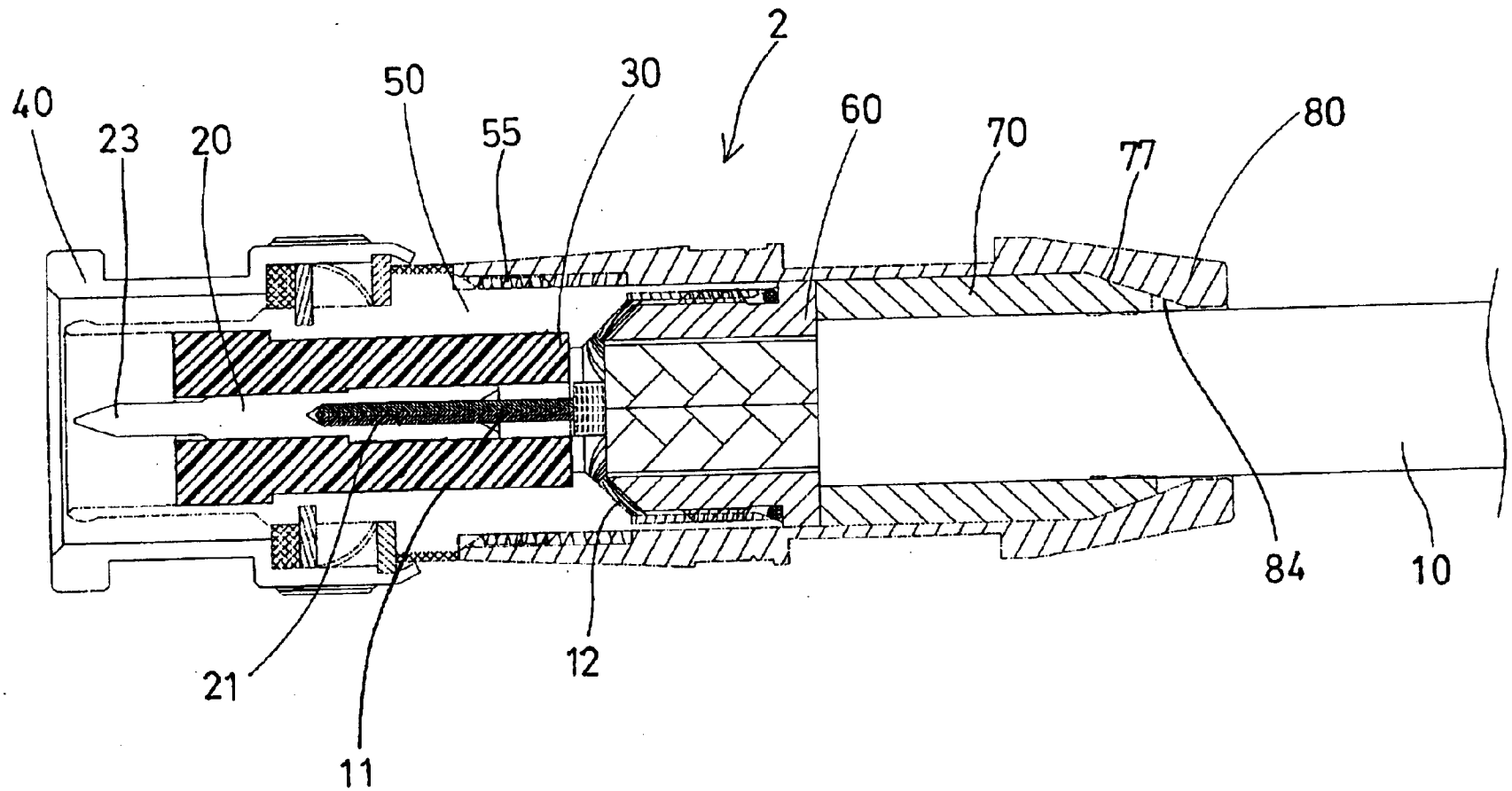
FIGS. 10, 11, 12, 13 are partial cross sectional views similar to FIG. 2, illustrating the other embodiments of the coaxial cable.

In operation, as shown in FIG. 7, the pipe 60 and the conduit 70 and the ferrule 80 may first be engaged onto the coaxial cable member 10, and the head 20 may be engaged onto the central conductor 11 of the coaxial cable member 10. The free end portion of the outer conductor 12 may then be folded outwardly and engaged onto the outer peripheral portion of the pipe 60 (FIG. 2).

The tubular housing 50 may then be engaged onto the pipe 60, and the inner thread 56 of the tubular housing 50 may be threaded with the outer thread 62 of the pipe 60, and the inclined surface 53 of the peripheral swelling 52 of the tubular housing 50 may then be forced to engage with the inclined surface 63 of the pipe 60, so as to solidly retain and secure free end portion of the outer conductor 12 between the tubular housing 50 and the pipe 60.

The inner thread 83 of the ferrule 80 may then be threaded with the outer thread 55 of the tubular housing 50, and the inclined surface 84 of the ferrule 80 may be engaged onto or forced against the inclined surface 77 of the conduit 70, and in order to force the inner peripheral teeth 73 of the blades 75 of the conduit 70 onto the coaxial cable member 10, and so as to solidly clamp or secure the conduit 70 onto the coaxial cable member 10.

The head 20 and the sleeve 30 and the connector 40 may be solidly secured to the tubular housing 50 with the barrel 34, before or after the tubular housing 50 is threaded onto the pipe 60, and before or after the ferrule 80 is threaded onto the tubular housing 50.

The barrel 34 and the pipe 60 and the conduit 70 and the ferrule 80 may be made of either conductive or insulating materials. The connector 40 and the tubular housing 50 are made of conductive material, for electrically coupling to the outer conductor 12 of the coaxial cable member 10. The sleeve 30 is made of insulating materials, to prevent the head 20 and the central conductor 11 of the coaxial cable member 10 from being electrically contacted with the connector 40.

Accordingly, the coaxial cable in accordance with the present invention includes a coupler which may be easily and quickly attached or secured onto the coaxial cable member without additional fasteners or tool members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

What is claimed is:

1. A coaxial cable comprising:

a coaxial cable member including a central conductor and an outer conductor, a pipe engaged onto said coaxial cable member and including an outer thread formed thereon, a conduit engaged onto said coaxial cable member and contacted with said pipe, and including at least one tooth engaged onto said coaxial cable member, for securing said conduit onto said coaxial cable member, said outer conductor of said coaxial cable member being engageable onto said pipe, a tubular housing including an inner thread formed therein to thread with said outer thread of said pipe, and including a peripheral swelling extended therein to engage with said outer conductor of said coaxial cable member, and to retain said outer conductor of said coaxial cable member between said peripheral swelling of said tubular housing and said pipe, said tubular housing including an outer thread formed thereon, a head engaged onto said central conductor of said coaxial cable member, and including a tip extended therefrom, an insulating sleeve including a passage formed therein to receive said head, and received in said tubular housing, and a ferrule including a chamber formed therein to receive said coaxial cable member and said pipe and said conduit, and including an inner thread formed therein to thread with said outer thread of said tubular housing, and to secure said tubular housing and said pipe and said conduit to said coaxial cable member, said ferrule including an actuating member provided therein to engage with said conduit and to force said at least one tooth of said conduit onto said coaxial cable member.

2. The coaxial cable as claimed in claim 1, wherein said conduit includes at least one groove formed therein to define at least one blade thereon, and to increase a resilience of said conduit, and to allow said at least one tooth of said conduit to be resiliently clamped onto said coaxial cable member.

3. The coaxial cable as claimed in claim 1, wherein said pipe includes an inclined surface formed therein to engage with said outer conductor of said coaxial cable member.

4. The coaxial cable as claimed in claim 3, wherein said tubular housing includes an inclined surface formed in said peripheral swelling thereof, to engage with said inclined surface of said pipe, and to retain said outer conductor of said coaxial cable member between said inclined surfaces of said tubular housing and said pipe.

5. The coaxial cable as claimed in claim 1, wherein said conduit includes an inclined surface formed therein, said actuating member of said ferrule is an inclined surface to engage with said inclined surface of said conduit, and to force said at least one tooth of said conduit onto said coaxial cable member.

6. The coaxial cable as claimed in claim 1, wherein said head includes a bore formed therein to receive said central conductor of said coaxial cable member, and includes at least one slot formed therein to increase a resilience of said head.

7. The coaxial cable as claimed in claim 1 further comprising a tubular connector, and a barrel engaged through said connector and secured to said tubular housing, to rotatably attach said connector to said tubular housing.

8. The coaxial cable as claimed in claim 7, wherein said tubular connector includes a peripheral rib extended therein, and said barrel includes a peripheral flange extended outwardly therefrom, to engage with said peripheral rib of said connector, and to rotatably couple said connector to said tubular housing.

9. The coaxial cable as claimed in claim 7, wherein said barrel includes a peripheral rib extended therein to engage with said sleeve, and to retain said sleeve within said barrel.

10. The coaxial cable as claimed in claim 1, wherein said sleeve includes a peripheral flange extended therein to engage with said head, and to retain said head within said sleeve.

* * * * *